US005174441A

United States Patent [19]

Marco

[11] Patent Number: 5,174,441

[45] Date of Patent: Dec. 29, 1992

[54] TEAR-OPEN CONTAINER CARRIER

[75] Inventor: Leslie S. Marco, Bloomingdale, Ill.

[73] Assignee: Illinois Tool Works Inc., Glenview, Ill.

[21] Appl. No.: 888,475

[22] Filed: May 22, 1992

Related U.S. Application Data

[63] Continuation of Ser. No. 686,612, Apr. 17, 1991, abandoned.

[51] Int. Cl.[5] ..... B65D 71/00

[52] U.S. Cl. ..... 206/150; 206/151; 206/158; 294/87.2

[58] Field of Search ..... 206/139, 150, 151, 158, 206/161, 199, 428; 294/87.2, 87.28

[56] References Cited

U.S. PATENT DOCUMENTS

| | | | |
|---|---|---|---|
| 2,997,169 | 8/1961 | Poupitch | 206/150 |
| 3,038,602 | 6/1962 | Rapata | 206/65 |
| 3,084,792 | 4/1963 | Poupitch | 206/56 |
| 3,721,337 | 3/1973 | Braun et al. | 206/150 |
| 3,778,096 | 12/1973 | Smith | 206/150 |
| 3,874,502 | 4/1975 | Weaver | 206/150 |
| 4,064,989 | 12/1977 | Olsen | 206/428 |
| 4,219,117 | 8/1980 | Weaver et al. | 206/150 |
| 4,385,690 | 5/1983 | Olsen | 206/428 |
| 4,544,194 | 10/1985 | Allen | 206/150 |
| 4,546,876 | 10/1985 | Rhoads | 206/158 |
| 4,550,824 | 11/1985 | Rhoads | 206/150 |
| 4,752,001 | 6/1988 | Olsen | 206/150 |
| 4,925,020 | 5/1990 | Gordon | 206/150 |
| 5,020,661 | 6/1991 | Marco | 206/150 |

*Primary Examiner*—David T. Fidei

*Attorney, Agent, or Firm*—Trexler, Bushnell, Giangiorgi & Blackstone, Ltd.

[57] ABSTRACT

A tear-open container carrier is provided having integral webs defining container encircling apertures for accepting and firmly holding containers therein. The integral webs have bridges extending from the container encircling apertures to a tear strip which is capable of accepting a force. The bridges have force and tear directing and propagating lines. When a force is applied to the tear strips, the carrier bands rupture under the influence of the force and tear directing and propagating lines, thereby opening the container encircling apertures, and allowing the quick and easy removal of the containers from the carrier.

5 Claims, 1 Drawing Sheet

TEAR-OPEN CONTAINER CARRIER

This application is a continuation of application Ser. No. 686,612, filed Apr. 17, 1991, now abandoned.

BACKGROUND AND SUMMARY OF THE INVENTION

The invention pertains to sheet plastic devices for forming packages of a plurality of containers. The present invention relates generally to a unique construction of a container carrier useful for holding a plurality of containers as a unit, which allows for the quick release of the containers held by the carrier. More specifically, the invention relates to a weakened section formed on the integral webs which can be ruptured under the influence of forces applied to the integral webs by means of a tear strip, thereby freeing the containers. Container carriers, roughly similar to the carrier of the present invention, have been in use for many years. Although such container carriers can be employed in many aspects, one of the more popular employments is to hold a plurality of beverage containing cans, bottles, or other containers together as a unit called a "six-pack."

The six pack, and other numbered units all have the same general construction. The patents of Rapata, U.S. Pat. No. 3,038,602, and Poupitch, U.S. Pat. No. 3,084,792, disclose the common structure. Generally, a blank in the form of a continuous sheet of flexible, elastic material, such as polyethylene, and the like, has apertures therein which accept and firmly hold a plurality of containers.

The apertures have a periphery which is smaller than a corresponding periphery of the containers. Therefore, in order for the periphery of the apertures to accept the periphery of the containers, the apertures are stretched, often to the limits of their structural integrity. The periphery of the containers are inserted into the stretched apertures, and then the apertures are allowed to return toward their original condition, but the apertures do not achieve their original condition and remain tensioned due to the presence of the containers therein.

The periphery of the apertures constricts and forms around the periphery of the containers, thereby assuring that the containers are held snugly in the apertures of the carrier. This snug fit is a convenience to anyone employing the container carriers, such as consumers, merchants, and the like, when they transport the containers, such as to home after purchase, to a picnic, or to a merchandise display at some retail location. The elasticity of the material of the blank assures that the containers will be held firmly in the apertures.

To further insure a snug fit, and to add to the convenience of the consumer, both Poupitch and the patent of Rhoads, U.S. Pat. No. 4,550,824, disclose a band formed from the blank capable of being torn away from the blank. The band can be drawn downward to surround the containers, thereby adding further to the snug fit between the plurality of containers and the carrier.

The container carriers, in sheet form, are applied to a plurality of containers in assembly line fashion. The sheet of carrier containers, now bearing containers, is cut so that a single, smaller container carrier is formed. For a six pack construction, this cutting takes place after every sixth row of containers. Alternative numbered units will be cut in different locations, depending on the desired number of containers.

The container carriers, and thereby the containers, are moved down an assembly line to a place where they are placed within boxes, crates, or other suitable containers. The crates are then loaded into a vehicle of sorts for transport to a customer, a retailer, for instance. The retailer removes the container carriers and the associated containers from the crates and usually constructs an attractive merchandise display of the containers. The attractive merchandise displays draw the attention of consumers, who then purchase the containers for their own personal use.

OBJECTS AND SUMMARY OF THE INVENTION

A general object of the invention is to provide a container carrier having a quick release for removing the containers from the carrier.

An additional object of the invention is to provide a container carrier having means for releasing containers which provides a faster and easier method of removing containers from the carrier than currently available.

A further object of the invention is to provide a container carrier having container encircling bands having means for weakening segments of the container encircling bands providing weakened sections, with the weakened sections being able to rupture in order to release the containers.

An additional object of the present invention is to provide a container carrier having means for rupturing the weakened sections so that the containers can be removed easily from the carrier.

Another object of the invention is to provide a container carrier from which one can remove containers easily without the need of tools.

A further object of the present invention is to provide a container carrier which can be employed successfully with either cans, bottles, or other suitable containers.

A container carrier useful for releasably holding a plurality of containers as a single unit according to the present invention comprises a substantially planar blank formed of a resilient, deformable, elastic material. The blank has portions removed therefrom to form container encircling bands defining container encircling or receiving apertures disposed in juxtaposed rows. The container encircling bands are capable of accepting, and firmly holding containers therein. The container carrier has means for releasing containers including tear and force directing and propagating means, bridge means, and weakened sections for causing rupture of the container encircling bands. The weakened sections are connected with tear strip means capable of accepting a force and applying that force to the weakened sections so as to rupture them. When the weakened sections are ruptured, the container encircling bands are ruptured also, thereby releasing a container held within a container encircling aperture.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
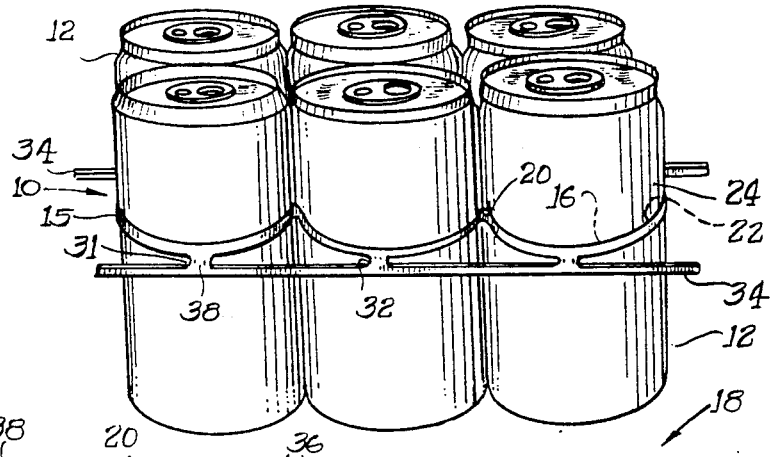
FIG. 1 is a perspective view of a plurality of containers releasably held together as a unit by a container carrier, constructed according to the teachings of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Referring initially to FIG. 1, a tear-open container carrier 10, constructed according to the teachings of the present invention, is shown holding a plurality of containers 12. Although the container carrier 10 is depicted holding six containers 12, it is to be understood that the invention is not limited to that number of containers 12. The container carrier 10 operates equally well with any number of containers 12.

Figure 2:
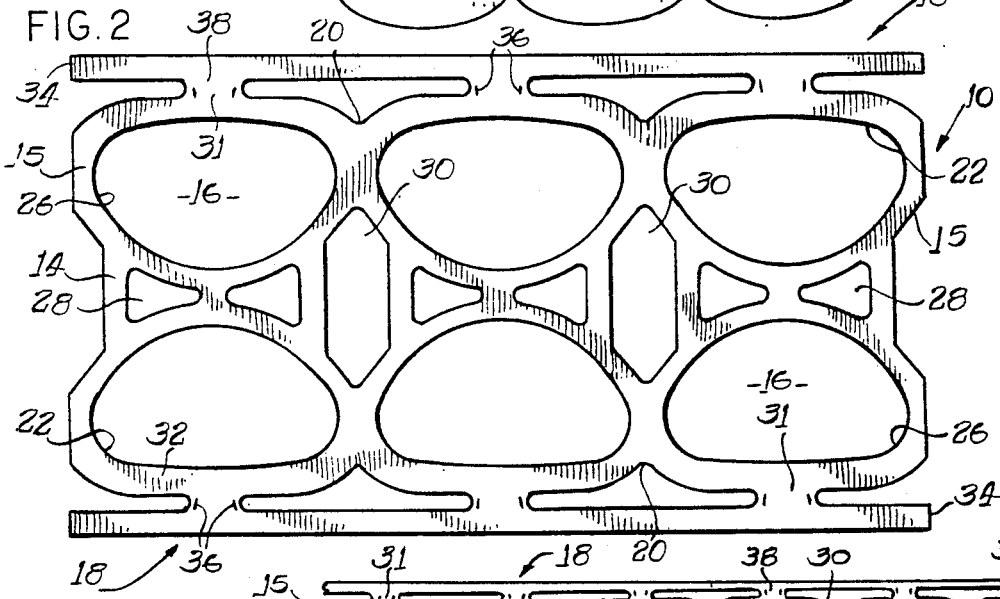
FIG. 2 is a plan view of the container carrier of FIG. 1, showing the disposition of the carrier without containers disposed in the container encircling apertures.

The general structure of a container carrier is disclosed, for example, in the patent of Rapata, U.S. Pat. No. 3,038,602, assigned to the assignee of the present invention. The disclosure of that patent is incorporated herein by this reference. Referring generally to FIG. 2, the particular construction of the container carrier 10 is shown. The container carrier 10 is formed from a substantially planar blank or sheet, not shown, of a resilient, deformable, elastic material, such as polyethylene, and the like. Preferably, the blank is composed of a resilient deformable, unsupported plastic sheet, such as, for example, low density polyethylene having a sheet thickness of 0.018 inches and a secant modulus at 2 percent elongation of approximately 36,000 p.s.i., as disclosed in the patent of Weaver, U.S. Pat. No. 3,874,502, assigned to the assignee of the present invention. The disclosure of that patent is incorporated herein by this reference. It is necessary that the material of the blank be sufficiently flexible and resilient, so that the container carrier 10 can be expanded to accept a container 12, and then constrict around, and hold firmly a plurality of containers 12, as will be discussed herein.

Portions are removed from the substantially planar blank to form integral webs 14. The integral webs 14 are substantially continuous, taking circuitous paths. The integral webs 14 form closed curves or container encircling bands 15 defining container encircling or receiving apertures 16. The container encircling bands 15 and the container encircling apertures 16 are disposed in juxtaposed rows 18, so as to hold the containers 12 in a similarly regular fashion. Preferably, each row 18 contains two container encircling apertures 16. The container encircling apertures 16 are spaced regularly along, and centered about a median line of the container carrier 10. This orderly configuration of the container encircling apertures 16, and thereby of the containers 12, allows for ease of storage of the filled container carriers 10, and the maximization of the available storage space, such as in a truck, or a refrigerator.

A plurality of juxtaposed rows 18 of container encircling apertures 16 are disposed along the blank. Portions are removed from the blank, exterior of the container encircling apertures 16, to form scallops 20, which are disposed between each adjacent row 18 of container encircling apertures 16. The scallops 20 help to further define the container encircling apertures 16, which preferably are of a shape similar to that of the containers 12.

Thus, each of the container encircling apertures 16 has an inner periphery 22 which is constructed so as to accept, and to constrict around a corresponding periphery 24 of the containers 12. Specifically, as disclosed in the patent of Weaver, et al., U.S. Pat. No. 4,219,117, assigned to the assignee of the present invention, the container encircling apertures 16 are of circumferential dimension less than the dimension of the container periphery 24 to be encircled. The disclosure of that patent is incorporated herein by this reference.

For example, if the containers 12 are substantially cylindrical in shape, the periphery 24 of the containers 12 will be substantially circular, and the periphery 22 of the container encircling apertures 16 will be substantially ellipsoidal in shape. The periphery 22 of the container encircling apertures 16 have rounded corners 26, which assist in the insertion of the containers 12 into the container encircling apertures 16, and also help to prevent tearing of the container encircling bands 15 defining the container encircling apertures 16 while containers 12 are inserted in the container encircling apertures 16.

The scallops 20 also add to the flexibility of the container encircling bands 15 defining the container encircling apertures 16, so that the periphery 22 of the container encircling apertures 16 can expand for insertion of containers 12 therein, and constrict around and conform to the periphery 24 of the containers 12. The scallops 20 and the rounded corners 26 do not interfere with, but encourage the constriction of the periphery 22, and prevent excessive elongation of the container encircling bands 15, so that the container encircling apertures 16 can fit tightly to a container 12. These added benefits of the scallops 20 and the rounded corners 26 will become more clear herein.

Latitudinal slots 28 are disposed between adjacent container encircling bands 15 in the same row 18 on a side of the container encircling apertures 16 opposite to the scallops 20. The latitudinal slots 28 add to the flexibility of the container encircling bands 15 defining the container encircling apertures 16, and provide benefits similar to those of the scallops 20, and the rounded corners 26.

Longitudinal slots 30 are disposed between two adjacent rows 18 of container encircling band 15, and are centered on a median line of the container carrier 10. The longitudinal slots 30 are of sufficient size to accept a human finger, so that the longitudinal slots 30 form means for holding and transporting the container carrier 10 when containers 12 are disposed within the container encircling apertures 16.

Exterior to the container encircling bands 15, segments 31 of the container carrier 10 are located preferably centered on lines extending from a center of the container encircling apertures 16. The segments 31 are elongated, and extend away from the container encircling bands 15 and container encircling apertures 16 to form bridge means 32. The bridge means 32 extend from the container encircling bands 15, away from the container carrier 10 proper, to tear strips 34 which combine with the bridge means 32 to form means for releasing containers. Each container encircling aperture 16 has its own corresponding bridge means 32, associated with the particular container encircling bands 15 defining each container encircling aperture 16, extending to a tear strip 34. In this manner, as will be described more fully below, the tear strips 34 are capable of rupturing a single container encircling band 15, and thereby open a single container encircling aperture 16, at a time.

Figure 4:
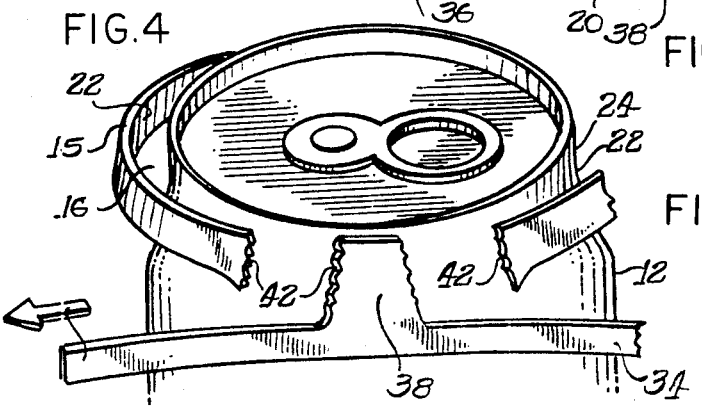
FIG. 4 is a perspective view of a portion of the container carrier, shown in FIG. 1, with one of the container encircling apertures ruptured, thereby facilitating the easy removal of the container.
Figure 5:
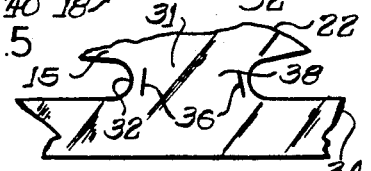
FIG. 5 is an enlarged partial plan view of the container carrier showing the force and tear directing and propagating means comprising a plurality of slits.
Figure 5A:
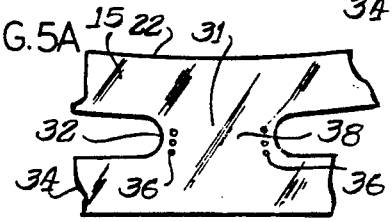
FIG. 5A is an enlarged partial plan view of the container carrier showing the force and tear directing and propagating means comprising a plurality of perforations.

The bridge means 32 have force and tear directing and propagating means 36 which weaken the segments 31. The force and tear directing and propagating means 36 can take on a variety of forms, such as a slit 37 shown in FIG. 1 through 5, a score line, or a line of perforations 39, as shown in FIG. 5A. Each of the above-disclosed forms of the force and tear directing and propagating means 36 functions equally well in the present invention.

The force and tear directing and propagating means 36 extends across the bridge means 32 from the tear strips 34 to an area proximate to the container encircling bands 15. This can be a single line, or a plurality of spaced apart, substantially parallel lines. However, it is important that the force and tear directing and propagating means 36 does not extend into the container encircling bands 15, for if the means 36 were to so extend, the container encircling apertures 16 may rupture when stretched during application of the container carrier 10 to the containers 12. The force and tear directing and propagating means 36 are used to propagate a tear through the container encircling bands 15 when a force is applied to the tear strips 34.

The force and tear directing and propagating means 36 causes a weakened section 38 to form on the bridge means 32. The weakened section 38 extends along the container encircling bands 15 from the outer periphery of the container encircling bands 15 to the tear strips 34. In this manner, as will be fully disclosed herein, a tear-open method for easily releasing a container 12 is provided.

The tear strips 34 extend along the entire length of the container carrier 10, and are capable of accepting a force, and transmitting that force to the bridge means 32. Once transmitted to the bridge means 32, the force can act upon the force and tear directing and propagating means 36, thereby rupturing the corresponding container encircling bands 15, and releasing a container 12.

The operation of the container carrier 10 will become more clear in the following discussion. In the modern mass production line, the material forming the blank is provided in the form of a roll. The roll is mounted in the machinery, with one end of the roll of blank material being fed into the machinery. The blank encounters a cutting machine, such as a punch press, well known in the art. The punch press removes sections of the blank to form the integral webs 14, the container encircling bands 15, the container encircling apertures 16, the scallops 20, the latitudinal slots 28, the longitudinal slots 30, the bridge means 32, the tear strips 34, and the force and tear directing and propagating means 36. The portions of the blank that are removed are collected, and can be recycled for further use.

Figure 3:
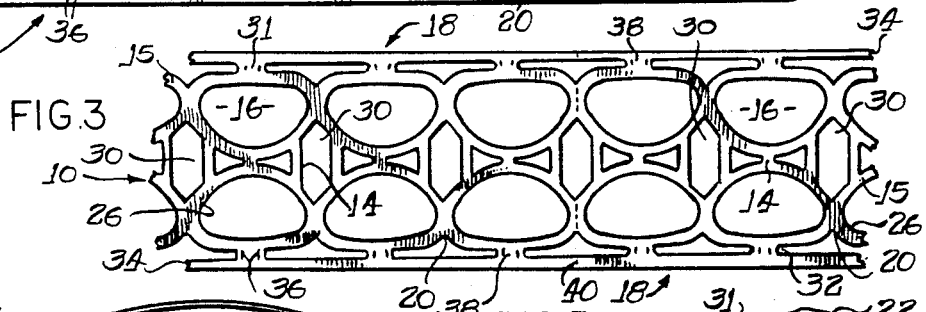
FIG. 3 is a partial plan view of a series of connected container carriers, shown in FIG. 2, showing the construction of the carriers as they are used in mass production.

As shown in FIG. 3, a plurality of container carriers 10 are formed in series on the sheet of blank material. The container carriers 10 are joined in series by joints 40 between two adjacent container carriers 10. The joint is sufficiently weak so as to rupture, thereby freeing a single container carrier 10 from the series, during the process of application of the container carriers 10 to the containers 12.

To apply the container carriers 10 to the containers 12, achieving the configuration shown in FIG. 1, the periphery 22 of the container encircling bands 15 is stretched. This is necessary because the periphery 22 of the container encircling bands 15 is smaller than the corresponding periphery 24 of the containers 12. The rounded corners 26 of the periphery 22 of the container encircling bands 15 assure that the integral webs 14 will not tear under the stress of the stretching, and the scallops 20 and the latitudinal slots 28 allow for maximum stretching of the periphery 22 of the container encircling bands 15. Once the periphery 22 is sufficiently stretched, the containers 12 are inserted therein.

Without the portions removed from the container carrier 10 to form the scallops 20 and latitudinal slots 28, it is possible that the constriction and conformity of the periphery 22 will be inhibited, or severely limited, thereby reducing the effectiveness of the container carrier 10 to retain containers 12. As the periphery 22 constricts around, and conforms to the periphery 24 of the containers 12, the container encircling bands 15 become frusto-conical in shape, as shown in FIG. 1. Now, the containers 12 are held firmly in the container encircling apertures 16. A consumer can insert his fingers into the longitudinal slots 30, and easily transport the container carrier 10 to a desired location.

When the consumer reaches his desired location, he will want to remove at least one of the containers 12 from the container carrier 10. To do this, the consumer applies an upwardly and outwardly directed force to either one or both of the tear strips 34, depending on how many containers 12 are to be removed. Also, the magnitude and duration of the force are dictated by the number of containers 12 to be removed.

As the consumer applies the force to the tear strips 34, that force is communicated to the bridge means 32, and then to the force and tear directing and propagating means 36. The force and tear directing and propagating means 36 causes the weakened sections 38 to rupture. This rupture progresses from the weakened sections 38, through the container encircling bands 15, and to the inner periphery 22 of the container encircling apertures 16. In this manner, the container encircling bands 15 are ruptured, thereby transforming the closed curve structure of the container encircling bands 15 into an open curve structure having a plurality of torn ends 42, as shown in FIG. 4. Now, the consumer can remove a container 12 from the container carrier 10 with relative ease.

This same procedure provides similar significant benefits to other persons, as well. For example, merchants often create intriguing merchandise displays in order to attract customers and to encourage them to purchase the merchandise. In the case of containers 12, held in container carriers 10, the merchant may desire to remove a certain number of containers 12 to create his merchandise displays thereof. Therefore, the merchant will also benefit from the present invention. Not only will the containers 12 not be aggitated, but also the time needed to create the merchandise displays can be significantly reduced because the merchant will not have to spend significant time and effort removing the containers 12 from the container carriers 10.

The structure of the container carrier 10, constructed according to the teachings of the present invention, provides an easily opened, tear-away method of removing containers 12 from the container carrier 10. Unlike other container carriers currently available, the container carrier 10 of the present invention does not require a sizeable force to remove the containers 12 therefrom. Also, no force is required to be applied to the containers 12, thereby preventing jostling of the containers 12, along with the attendant mess. Because the force needed to remove the containers 12 is relatively small, no tools are required. Additionally, because each container encircling aperture 16 has its own corresponding bridge means 32 and weakened section 38, a consumer can remove only one container 12 at a time, or any greater number of containers 12 from the container carrier 10. Also, this type of container carrier 10 can be employed with a number of different containers 12, such as bottles as well as cans, and different configurations of container peripheries 24, by simply varying the shape of the aperture periphery 22.

It should be understood that while certain preferred embodiments are shown herein, it is intended to cover all alternatives, modifications and equivalents as may be included within the spirit and scope of the invention as defined by the appended claims.

The invention claimed is:

1. A container carrier for releasably holding a plurality of containers as a single unit comprising: a substantially planar blank formed of a resilient, deformable, elastic material; the blank including a row of interconnected container encircling bands defining container encircling apertures; the container encircling bands for accepting, and firmly holding containers therein; separate discrete bridge elements respectively integrally joined to and extending from an outer periphery of each of said bands; force and tear directing and propagating means in each of said bridge elements; a single strip extending along a side of said row of bands and connected with all of the bridge elements proximate to the force and tear directing and propagating means for rupturing the bridge elements and the container encircling bands when the strip is manually pulled; and the force and tear directing and propagating means extending along the bridge elements toward and terminating short of the outer periphery of each of the container encircling bands.

2. A container carrier as defined in claim 1 wherein the force and tear directing and propagating means comprises a score line.

3. A container carrier as defined in claim 1 wherein the force and tear directing and propagating means comprises a pair of spaced apart score lines.

4. A container carrier as defined in claim 1 wherein the force and tear directing and propagating means comprises a line of perforations.

5. A container carrier as defined in claim 1 wherein the force and tear directing and propagating means comprises a pair of lines of perforations extending from the strip toward and terminating short of the outer periphery of each of the container encircling bands.

* * * * *